US011426778B2

(12) United States Patent
Sieghart et al.

(10) Patent No.: US 11,426,778 B2
(45) Date of Patent: Aug. 30, 2022

(54) METHOD FOR TENSION CONTROL

(71) Applicant: SMS GROUP GMBH, Düsseldorf (DE)

(72) Inventors: Jörn Sieghart, Hilden (DE); Ronny Peters, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 63 days.

(21) Appl. No.: 16/477,570

(22) PCT Filed: Jan. 12, 2018

(86) PCT No.: PCT/EP2018/050720
§ 371 (c)(1),
(2) Date: Jul. 12, 2019

(87) PCT Pub. No.: WO2018/130636
PCT Pub. Date: Jul. 19, 2018

(65) Prior Publication Data

US 2019/0366403 A1 Dec. 5, 2019

(30) Foreign Application Priority Data

Jan. 16, 2017 (DE) ..... 10 2017 200 560.2

(51) Int. Cl.
*B21B 37/52* (2006.01)
*B21B 37/46* (2006.01)

(52) U.S. Cl.
CPC ..... *B21B 37/52* (2013.01); *B21B 37/46* (2013.01); *B21B 2265/06* (2013.01); *B21B 2275/06* (2013.01); *B21B 2275/08* (2013.01)

(58) Field of Classification Search
CPC ..... B21B 37/52; B21B 37/46; B21B 2265/06; B21B 2275/06; B21B 2275/08; B21B 2275/02
See application file for complete search history.

(56) References Cited

U.S. PATENT DOCUMENTS 3,848,443 A * 11/1974 Peterson ..... B21B 37/52 72/8.6
3,863,478 A * 2/1975 Harada ..... B21B 37/52 72/10.4
4,132,095 A * 1/1979 Bowman ..... B21B 37/16 72/10.4

(Continued)

FOREIGN PATENT DOCUMENTS

CH 353436 A 4/1961
DE 2344920 A1 3/1974

(Continued)

*Primary Examiner* — Muhammad S Islam
*Assistant Examiner* — Devon A Joseph
(74) *Attorney, Agent, or Firm* — Lucas & Mercanti, LLP; Klaus P. Stoffel

(57) ABSTRACT

A method for tension control in a band-shaped material between two tension points, in particular between two adjacent roll stands, wherein at least one of the tension points has a rotary drive as an actuator. In order to make known tension controls of this type more effective and faster the controller output signal is varied in connection with the conversion thereof into the actuating signal for the rotary drive, at least temporarily, in dependence on a variable representing the band-shaped material.

21 Claims, 4 Drawing Sheets

(56) References Cited

U.S. PATENT DOCUMENTS

| | | | | | |
|---|---|---|---|---|---|
| 4,307,591 | A | * | 12/1981 | Peterson | B21B 37/50<br>226/25 |
| 4,662,202 | A | * | 5/1987 | Lambert | B21B 37/52<br>700/151 |
| 4,998,427 | A | * | 3/1991 | Peterson | B21B 37/52<br>72/8.6 |
| 5,012,660 | A | * | 5/1991 | Peterson | B21B 37/52<br>72/10.4 |
| 5,103,662 | A | * | 4/1992 | Fapiano | B21B 37/52<br>72/8.6 |
| 5,799,526 | A | * | 9/1998 | Mieze | B21B 37/66<br>72/11.4 |

FOREIGN PATENT DOCUMENTS

| | | | |
|---|---|---|---|
| DE | 102006048421 | A1 | 4/2008 |
| EP | 0455331 | A1 | 11/1991 |
| EP | 2454033 | B1 | 5/2012 |

* cited by examiner

METHOD FOR TENSION CONTROL

CROSS-REFERENCE TO RELATED APPLICATIONS

The present application is a 371 of International application PCT/EP2018/050720, filed Jan. 12, 2018, which claims priority of DE 10 2017 200 560.2, filed Jan. 16, 2017, the priority of these applications is hereby claimed and these applications are incorporated herein by reference.

BACKGROUND OF THE INVENTION

The invention relates to a method for tension control in band-shaped material, especially in a metal band, between two clamping points, wherein at least one of the clamping points has a rotary drive for influencing the tensile stress of the material. The clamping points may be, for example, two adjacent rolling stands.

A decisive criterion for a rolling mill, whether a hot rolling mill or a cold rolling mill, is the roll stability. The roll stability depends largely on the stability of the tension of the metal band being rolled. Tension controllers, i.e., controllers which regulate the control variable of tension, are basically known in the prior art, e.g., from EP 2 454 033 B1 or DE 10 2006 048 421 A1. The actuating element of the known tension controls may be, for example, the hydraulic adjustment in a rolling stand to adjust the working rolls. Preferably, the working rolls are position-controlled, since the position control has faster action on the tension than a tension control by adjusting the speed of the rotary drives of the rolls. A force control is often used at the last stands of a tandem mill, in order to introduce a particular surface roughness on the rolled metal band. Alternatively to the mentioned hydraulic adjustment of the rolls, the rotary drive of the rolls of a rolling stand with variable adjustment of the speed can also serve as the actuating element for the tension control, for example when using a force control.

During a rolling process, the most diverse of irregularities may occur, each time requiring a correction of the tension of the metal band. Examples or causes of such irregularities are:

- Before the start of a rolling process, a pass schedule is usually produced, which estimates or predicts the thickness decreases and the corresponding speed changes for each individual stand of a rolling mill. If it later turns out during the actual rolling process that the pass schedule does not conform to the reality, mass flow disturbances will occur, especially during acceleration and deceleration phases, which the tension controller must correct.
- New material is being rolled, or material with wrong rolling data is being rolled.
- The infeed thickness of the metal band in an individual rolling stand changes or the predicted desired tension and/or the lubrication conditions differ in reality from the plan. This likewise means a mass flow disturbance causing tension disturbances during accelerated runs, caused solely by the speed changes.
- Wear on the rolls.

All the mentioned situations cause tension disturbances, which need to be corrected as fast as possible by the tension control. Otherwise, an unstable rolling process will occur, even to the point of band cracks. A tension disturbance not corrected soon enough usually increases the off-dimension length of the metal band being rolled, i.e., the length of the metal band which cannot be sold afterwards, because the thickness tolerances desired by the customer cannot be maintained.

The tension controls known in the prior art, which employ the rotary drive of the rolls of a rolling stand as an actuating element, suffer from the drawback that they are often too slow for the many and often occurring aforementioned problems in the rolling process that require a correction.

SUMMARY OF THE INVENTION

Therefore, the problem which the invention proposes to solve is to modify a known method for the control of the tension in a band-shaped material between two clamping points so that the tension control becomes faster and more effective.

This problem is solved by the method proposed in patent claim 1. This method is characterized in that the controller output signal is varied in connection with its conversion into the actuating signal at least temporarily in dependence on a variable g(t) representing the speed of the metal band.

The term "at least temporarily" means that the conversion of the controller output signal into the actuating signal according to the invention need not always occur during a tension control.

The conversion according to the invention may be turned off during individual phases of the tension control, for example before the tension control has reached a steady state.

The term "a (physical) variable representing the speed of the band-shaped material" should be interpreted broadly. The term means on the one hand the speed of the metal band itself. On the other hand, however, it also includes any other physical variable enabling an indication of the magnitude of the speed of the metal band between the two clamping points. For example, it also includes the rotary speed or the circumferential speed of rolls in a rolling stand when such a rolling stand is acting as a clamping point in the sense of the invention. Neither must the variable necessarily be a measured value.

The term "metal band" is used always only as an example in the present description and the present claims. Each time, it is synonymous with band-shaped material of any given substance to which the invention pertains in general.

The present invention only pertains to tension controls in which a rotary drive functions as the actuating element and in which therefore an actuating signal dictates rotary speeds or rotary speed changes for the rotary drive.

The key idea of the invention is that the output signal of the tension controller—unlike in the prior art—does not serve directly as the actuating signal for a rotary drive in a clamping point, such as in a rolling stand, but rather is at first further processed or converted. This conversion according to the invention advantageously has the effect of pre-controlling tension disturbances in the metal band caused by speed changes.

Advantageously, the converting of the controller output signal into the actuating signal for the rotary drive according to the invention makes it possible to significantly simplify and shorten a formerly typically very cost and time intensive process of setting up a tension controller. Thus, when the method according to the invention is used, a plurality of metal bands consumed thus far for test purposes, especially for step tests during the setup process, and the time expense for specialists previously necessary to adjust the tension controller dynamics for different speed ranges, can be significantly reduced.

The first variant of the tension control according to the invention describes a pilot control, having no speed-dependent influence on the system gain V(t) yet still making necessary changes in the tension controller output signal R(t) relative to the variable g(t) representing the speed of the metal band. This first variant of the tension control according to the invention works with learning points. If the number of learning points increases toward infinity, the tension correction becomes directly dependent on the speed of the mill and thus also on its system gain.

The actuating signal S(t) is computed according to the first variant of the tension control according to the invention from the controller output signal R(t) by the following formula:

$$S(t) = R(t) - \sum_{t_i \le t} (A_1(t_i)) + \frac{g(t)}{g(t_0)} * \sum_{t_i \le t} \left( \frac{A_1(t_i)}{V(t_i)} \right) \tag{2}$$

with:
A1(t0) given
Z(t0) given
$t_i$: learning times
$t_0$: first learning time
and with $$V(t) = \frac{g(t)}{g(t_0)}, \tag{1}$$

where V(t) is a gain factor, representing the profile of the variable g(t) representing the speed of the metal band (200) plotted against time, preferably normalized to the given constant g(to).

Learning points $t_i$ according to the invention are generated on the basis of real perturbing influences, such as changes in manual reference tensions, redistributions, general perturbations from the process, etc. On account of these perturbing influences/events, as pointed out also in claim 3, the ambient conditions for the tension control change. The mentioned learning points help adapt the controller output at once and exactly to the currently altered circumstances of the mass flow. Accordingly, the first variant of the tension control according to the invention describes an adaptive pilot control. The tension control becomes faster overall, and the actuating signal S(t) perhaps ideally no longer has to perform any corrections, or probably only slight corrections, if the mill changes its speed after and during a disturbance.

Another embodiment describes various situations when the tension control is operated according to the first variant, i.e., under what conditions the actuating signal is preferably computed by formula 2. This is especially the case when the variable representing the speed of the metal band lies between an upper and a lower threshold value or when the mass flow is not the dominant variable for the dynamics of the tension control, but instead some other physical variable is.

In the second variant of the tension control, once again at first the gain factor V(t) is formed according to the above given formula 1. The actuating signal S(t) is then formed according to the following formula:

$$S(t)=R(t)*V(t), \tag{3}$$

In this second variant, the output of the tension controller R(t) is directly increased or decreased with the gain factor V(t), which may vary continuously with the speed of the mill, and thus it is converted into the actuating signal S(t).

By contrast with the first variant, the second variant in addition to the pilot control supported in event of speed changes also influences the dynamics of the controller itself. Thus, assuming as an example a perturbation variable a and a speed b, the correction of the controller ΔR may occur at the drive, which in turn yields an actuating signal ΔR=>ΔS1 for the rotary drive according to the invention. Now, if the speed b changes to the speed c with c≠b, the same assumed perturbation a may bring about the same correction of the controller ΔR, however there will be a different reaction of the actuating signal ΔR=>ΔS2 with ΔS2≠ΔS1. This speed-dependent difference of the actuating signal ΔS(t) likewise holds for accelerating and constant runs.

The control engineering benefits of the second variant over the prior art corresponds to the benefits of variant 1. In addition, variant 2 affords the possibility of significantly reducing the expense of setting up the tension control, since the dynamics of the control system is automatically changed by the factor V(t), analogously to the speed, and therefore this does not need to be adjusted by trial and error, or only to a lesser degree.

The second variant is preferably used, i.e., the actuating signal is preferably computed by formula 3, when the variable g(t) representing the speed of the metal band falls below a given upper threshold value $g_{max2}$ and goes beyond a given lower threshold value $g_{min2}$; or when the mass flow is the dominant variable for the dynamics of the tension control; or when the amplification signal V(t) is supposed to have a greater influence on the dynamics of the tension control than in formula 2; or before the tension control is in a steady state, in which case then preferably: V(t)=1.

Optionally, the tension control may be switched from the second variant to the first variant as soon as and for as long as the variable representing the speed of the metal band, especially the speed of the metal band itself, goes beyond a given positive speed limit. This speed limit is defined for example by the lower threshold value $g_{min1}$ of variant 1, when this is larger than the upper threshold value $g_{max2}$ of the second variant. As soon as the variable g(t) representing the speed of the metal band once more falls below this speed limit, the system may switch back to variant 2 again. The temporary switchover means that the speed correction will again be changed in accordance with the mass flow, but the tension controller maintains the gain constant at high speeds.

The controller gain must be held constant, for example, when the dynamics of the rotary drives is or becomes the limiting variable for the dynamics of the tension controller.

Both the first and the second variant are preferably used when the tension control is in a steady state.

It may be advantageous for the gain factor V(t) to be limited to a constant value if the variable g(t) representing the speed of the metal band goes beyond a given threshold value $g_{maxi}$. This makes it possible, at high speeds, to hold the correction of the tension controller absolute and the gain of the controller constant. The limitation of the gain factor may be advisable in both variants of the tension control.

Likewise for both variants it may be advisable to limit the actuating variable S(t) in dependence on or relative to the variable representing the speed of the metal band. In mathematical terms, this then yields the following.

$$S_{min}(g(t)) < S(t) < S_{max}(g(t)) \tag{7}$$

This protects the mill, e.g., in event of undetected band cracks at low speeds. Thanks to the relative limiting, the controller limits $S_{min}(g(t))$ and $S_{max}(g(t))$ are more open at high speeds g(t) than in the case of low speeds. For example, we have:

$$S_{min}(g(t))=-g(t)*0.4;$$

$$S_{min}(g(t))=g(t)*0.4;$$

Advantageously, the actuating signal S(t) or the gain factor V(t) in the first and/or in the second variant is respectively computed by factoring in the forward slip k of the metal band, preferably by multiplication with a function f(k). The forward slip k represents the difference between the speed g(t) of the metal band and the circumferential speed $V_{cx}$ of the working rolls rolling the metal band in a rolling stand according to the following formula:

$$g(t)=V_{cx}(k+1) \tag{8}$$

According to the first variant, the actuating signal S(t) is then computed as follows:

$$S(t)=\left[R(t)-\sum_{ti\leq t}(A_1(t_i))+\frac{g(t)}{g(t_0)}*\sum_{ti\leq t}\left(\frac{A_1(t_i)}{V(t_i)}\right)\right]*f(k) \tag{9}$$

According to the second variant, the actuating signal S(t) is computed by factoring in the forward slip as follows:

$$S(t)=[R(t)*V(t)*f(k)] \tag{10}$$

By factoring in the forward slip, the tension control according to the invention is preadjusted or precontrolled even better to speed-changing perturbations and in this way becomes even more rapid and effective.

The forward slip k itself can either depend on the variable g(t) representing the speed of the metal band in the form k(g(t)) or be given as a constant.

If, alternatively or additionally to the actuating signal S(t), a derivative signal of form dS(t)/dt is also generated and put out for the actuating of the rotary drive, the rotary drive can be actuated even more precisely with it, because a correction of the acceleration of the rotary drive is also possible with this derivative signal. The possibility of using the derivative signal also exists both in the first and in the second variant.

While the actuating signal S(t) in the context of the present invention always dictates a rotary speed or a change in the rotary speed for a rotary drive, the controller output signal R(t) may represent either a change in the rotary speed for the rotary drive or dictate a thickness change for the metal band in a rolling stand. In the latter case, a conversion of the controller output signal into the actuating signal for the rotary drive must then be done.

The two clamping points between which the metal band is stretched under tension can be two preferably neighboring rolling stands of a rolling mill, wherein at least one of the rolling stands comprises the rotary drive for driving the rotation of one of its rolls. In a special embodiment, a thickness control is then done at the first rolling stand in the rolling direction, and at the following second rolling stand in the rolling direction the tension control according to the invention is performed with an actuation of the rotary drive present there as the actuating element. Thanks to the preceding speed control, the following tension control is significantly easier, i.e., the actuating signal only needs to put out minor changes in the rotary speed to the rotary drive.

In the layout described in the last paragraph, it is advantageous when the controller output signal on the one hand represents said change in the thickness decrease of the metal band for the thickness control at the first rolling stand and accordingly functions as the actuating signal for the thickness decrease at the first rolling stand. The controller output signal R(t) on the other hand can then be converted according to the first or second variant of the tension control according to the invention into the actuating signal for the rotary drive, wherein the conversion also involves a conversion of the change in the thickness decrease into a change in the rotary speed for the rotary drive.

As for the two clamping points between which the tension of the metal band is controlled with the method according to the invention, alternatively a pair of rolls can be the first clamping point and a coiling device downstream from the pair of rolls in the rolling direction can be the second clamping point. The rotary drive needed by the tension control according to the invention can then be present either at the pair of rolls for driving the rotation of a least one of its rolls and/or at the coiling device for driving the rotation of the coil. The pair of rolls may be a pair of drive rolls or a pair of working rolls in a rolling stand.

BRIEF DESCRIPTION OF THE DRAWING

Four figures are included with the description, in which.

DETAILED DESCRIPTION OF THE INVENTION

The invention shall be described below in detail with reference to the mentioned figures in the form of exemplary embodiments.

Figure 1:
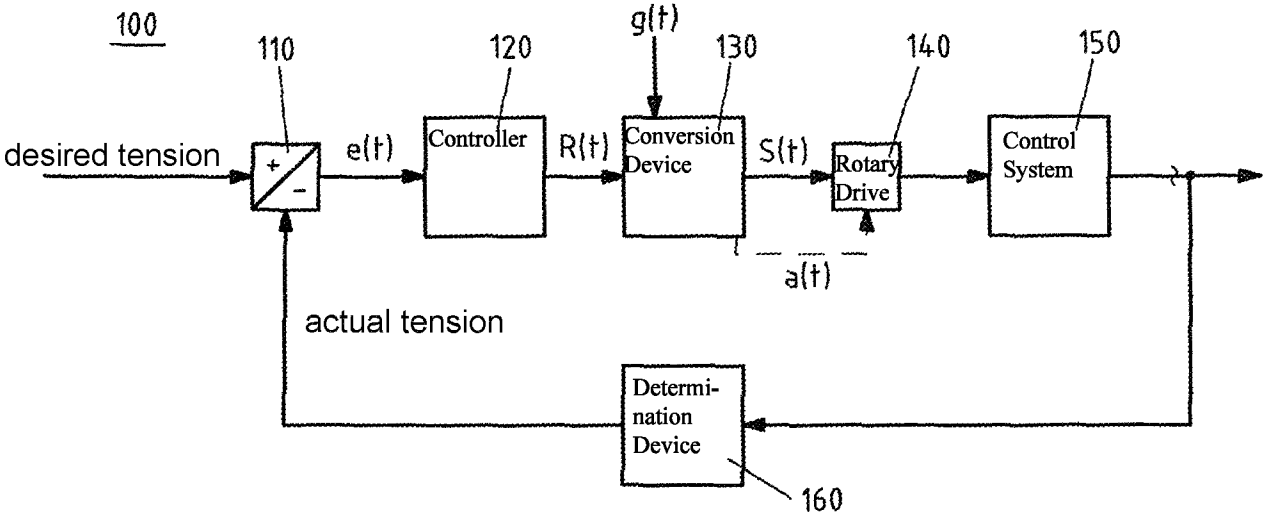
FIG. 1 shows a diagram of a tension control according to the invention.

FIG. 1 shows a diagram 100 of a tension control according to the present invention. The foundation of the invention is a feedback circuit for a tension control, as shown generally in FIG. 1. The feedback circuit calls for measuring or otherwise ascertaining the actual tension of a metal band with the aid of a determination device 160 when the metal band is clamped between two clamping points under tension or when it runs through these clamping points under tension. The term tension is synonymous here with tensile stress. The actual tension so determined is compared in a desired/actual value comparator 110 to a given desired tension for the metal band, and the result of this comparison, which typically involves the formation of a difference, is put out as a control error e(t) to a controller 120. The controller generates at its output a controller output signal R(t).

This controller output signal R(t) typically represents a rotary speed change for a rotary drive. According to the invention, however, the controller output signal R(t) does not serve directly as an actuating signal for the actuating of an actuating element 140 in the form of a rotary drive, but instead the present invention calls for the controller output signal at first being transformed in a conversion device 130 in suitable manner, as will be described below, into an actuating signal S(t). Then only the actuating element S(t) will in fact serve for actuating the rotary drive 140. The rotary drive 140 is actuated in such a way that the tension of the metal band 200 is adjusted to the given desired value when the metal band runs through the control system 150, which substantially consists of two clamping points. The described control process preferably works continuously in time, so that the aforementioned determination of the actual tension of the metal band occurs continuously within the control system and the ascertained actual tension is adjusted continuously to the given desired tension.

Figure 2:
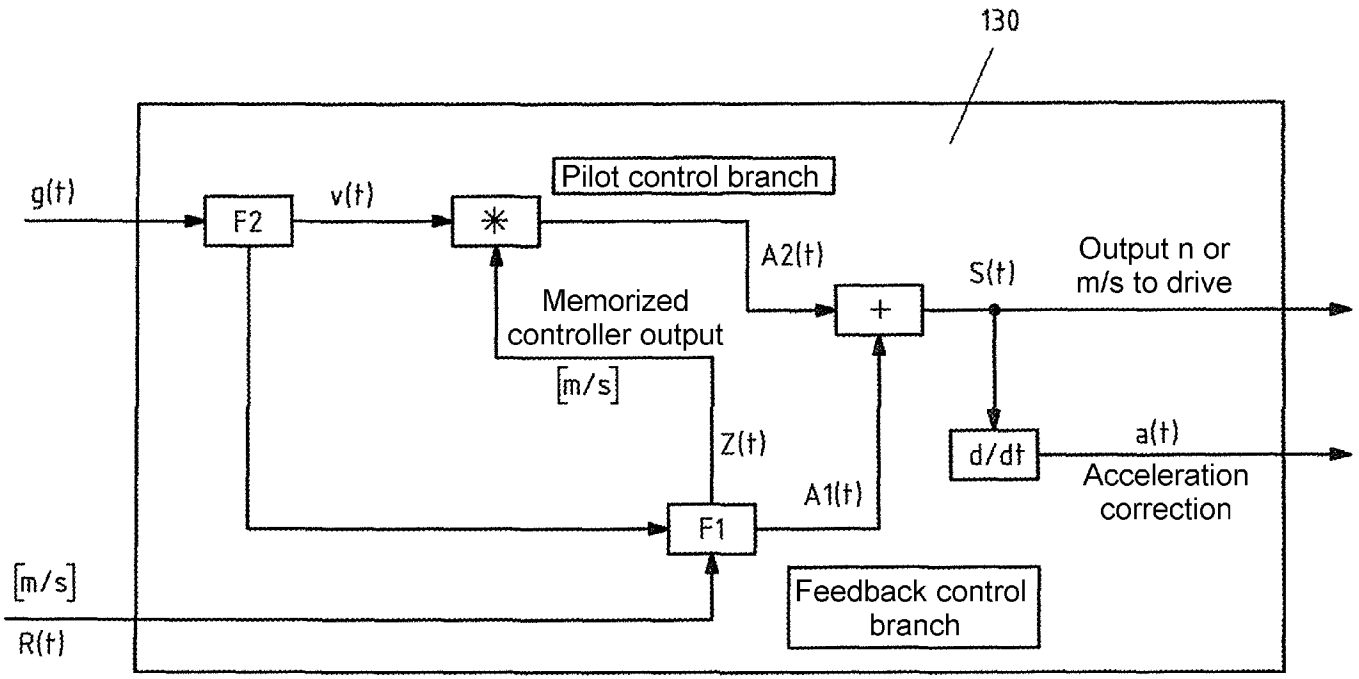
FIG. 2 shows a diagram on the conversion of a controller output signal R(t) into an actuating signal S(t) according to the invention.
Figure 3:
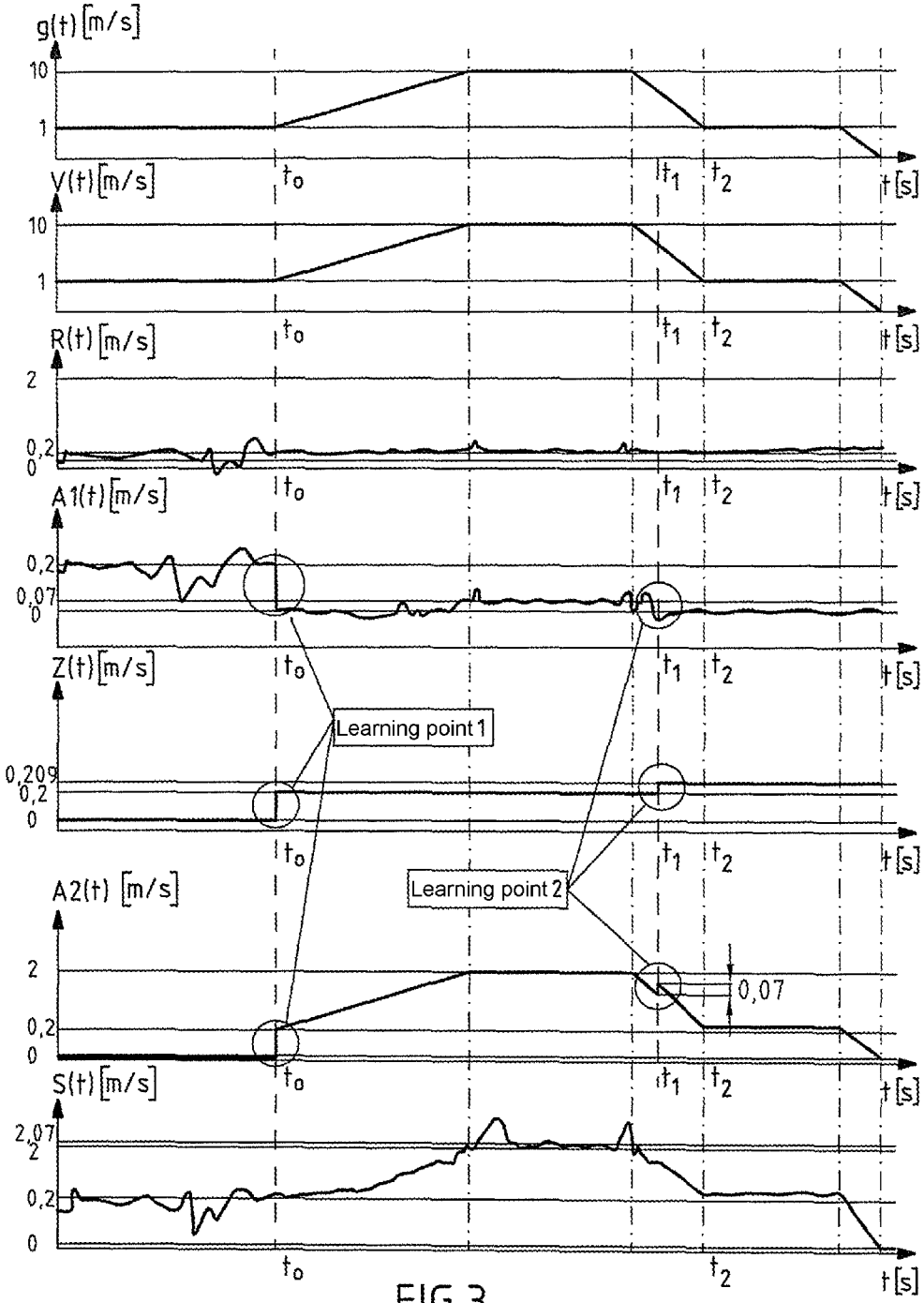
FIG. 3 shows exemplary signal plots for a first variant of the method according to the invention.

FIG. 2 shows the functional layout of the conversion device 130 shown in FIG. 3, in detail.

First of all, it will be recognized that the conversion device 130 receives the controller output signal R(t) as an input variable and puts out said actuating signal S(t) as its output variable to the rotary drive 140 as the actuating element. Besides the controller output signal (R(t), the conversion device 130 furthermore receives a variable g(t) representing the speed of the metal band 200. This may be the particular speed of the metal band itself; but it may also be any other physical variable allowing an indication of the variable of the speed of the metal band between the two clamping points.

Besides the actuating signal S(t), it may be advisable to also put out its time derivative dS(t)/dt=a(t) as an output signal a(t) to the rotary drive 140. The derivative signal a(t) then enables an acceleration correction for the rotary drive.

The tension control according to the invention and especially the conversion device 130 may be operated in a first variant or alternatively in a second variant; depending on the variant, the functional blocks F1 and F2 within the conversion device 130 will be operated and configured differently. The respective different configuration and functioning of the conversion device 130 shall now be described primarily in mathematical form for both variants.

For both variants, the block F2 within the conversion device 130 provides for the generating of a gain factor V(t), in which the received input signal g(t) is preferably normalized to a given constant g(to). Therefore, for V(t):

$$V(t) = \frac{g(t)}{g(t_0)} \tag{1}$$

I. Description of the First Variant

For the first variant of the tension control according to the invention, the conversion device 130 per FIG. 2 computes the actuating signal S(t) as follows:

$$S(t) = A_1(t) + A_2(t) \tag{2.1}$$

$$A_1(t) = R(t) - (A_1(t_0) + A_1(t_1) + A_1(t_2) + \ldots + A_1(t_n)) \quad \text{with } t_n \le t$$

$$A_2(t) = V(t) * (Z(t_0) + Z(t_1) + Z(t_2) + \ldots + Z(t_n)) \quad \text{with } t_n \le t$$

$$Z(t_i) = \frac{A_1(t_i)}{v(t_i)}$$

$$V(t) = \frac{g(t)}{g(t_0)} \tag{1}$$

Hence:

$$S(t) = R(t) - \sum_{t_i \le t}(A_1(t_i)) + \frac{g(t)}{g(t_0)} * \sum_{t_i \le t}\left(\frac{A_1(t_i)}{V(t_i)}\right) \tag{2}$$

with $t_i$: time of a learning point $t_0$: time of the first learning point

FIG. 3 illustrates the generating of the actuating signal S(t) as the output signal of the conversion device 130 according to the first variant with the aid of specific examples for the input signals g(t) and R(t). In the example in FIG. 3, the gain factor V(t) is identical in its time plot to the input signal g(t), i.e., the normalization factor g(to) was set here at 1, for example. Besides the gain factor V(t), various other intermediate signals A1(t), Z(t) and A2(t) are generated within the conversion device 130, from which the actuating signal S(t) is ultimately computed. The computation of the intermediate signals is mathematically represented above and, as mentioned, is explained by an example in FIG. 3.

One special feature in the context of the tension control by the first variant is that times $t_i$ at which special events occur are defined as so-called learning times. In the following, several examples of such events will be given, at which a learning time is set or triggered: $g(t)=g_{LPi}$ **If the current speed g(t) reaches a given or parametrized speed $g_{LP}$, a learning point will be thus triggered $g_{LP}$ [m/s]: learning point speed with: $g_{LPi}$: speed at which a learning point should be set; or $$\frac{dg(t)}{dt} \neq 0$$

**Preferably the reference acceleration will be analyzed. If the mill begins a positive or negative acceleration phase with $$\frac{dg(t)}{dt} \neq 0,$$

a learning point will thus be set at this time;
or $$\frac{dg(t)}{dt} \neq 0 \wedge |A_1(t)| \geq A_{1Max}$$

**If during an acceleration phase $$\frac{dg(t)}{dt} \neq 0$$

the magnitude of $A_1(t)$ exceeds a certain value $A_{1Max}$, a learning point will be triggered.

Two of the just described events for the triggering of learning points are illustrated in FIG. 3. Thus, one will recognize in FIG. 3 that the learning time 1 is then or therefore set at time to because the mill at time to is starting an acceleration phase; in FIG. 3 this can be recognized in that the variable g(t) representing the speed of the metal band changes at this time. Specifically, the variable g(t) increases at this time, starting from a previously constant quantity, i.e., it starts a positive acceleration phase at time to. The second learning time in FIG. 3 is triggered because the left-side limit value of $A_1(t)$ reaches a given value $A_{1max}$. or falls to this value during the then prevailing negative acceleration phase, i.e., during the prevailing deceleration phase. The setting of the learning points in each case has the effect that the function $A_1(t)$ has a step at the learning times, because it is then computed by formula 2.1 from the controller output signal R(t) minus a particular magnitude.

Thanks to the set learning points, the pilot control is adapted at once and exactly to the current circumstances, in particular to speed-related changes in the mass flow. Thanks to the setting of the learning points, the future controller output signal R(t), i.e., the controller output signal after the particular set learning time, will be copied in the form of the signal Z(t) to the pilot control branch; see FIG. 2, so that the actuating signal S(t) overall does not change by the setting of the learning times. Otherwise, if a change occurs in the mill speed, the newly learned mass flow disturbance will be automatically precontrolled by the conversion device 130, in that the mass flow control is once more changed in linear manner to the mill speed by the actuating signal S(t). Ideally—if the actuating signal (St) has previously been ideally adapted to the change in the mill speed—the controller output signal R(t) must then perform little or no corrections when the mill changes its speed, i.e., when a change occurs in g(t).

FIG. 3 shows as examples signal plots for the input signals R(t) and g(t) and the actuating signal S(t) computed from them by formula 2 in the conversion device 130. A comparison of the controller output signal R(t), which typically serves in the prior art directly as the actuating signal for a downstream rotary drive, with the actuating signal S(t) computed according to the invention reveals, especially between the times $t_0$ and $t_2$, that the controller output signal R(t) has been weighted or varied with the variable g(t) representing the speed of the metal band or the gain factor V(t) in order to compute the actuating signal S(t).

II: Description of the Second Variant

According to FIG. 2, the actuating signal S(t) in the second variant is computed in dependence on the controller output signal R(t) as follows:

$$S(t)=A1(t)+A2(t)$$

$$A_1(t)=0$$

$$A_2(t)=V(t)\times Z(t) \text{ with } Z(t)=R(t)$$

Hence:

$$S(t)=V(t)\times R(t) \tag{3}$$

with $$V(t)=\frac{g(t)}{g(t_0)} \tag{1}$$

Figure 4:
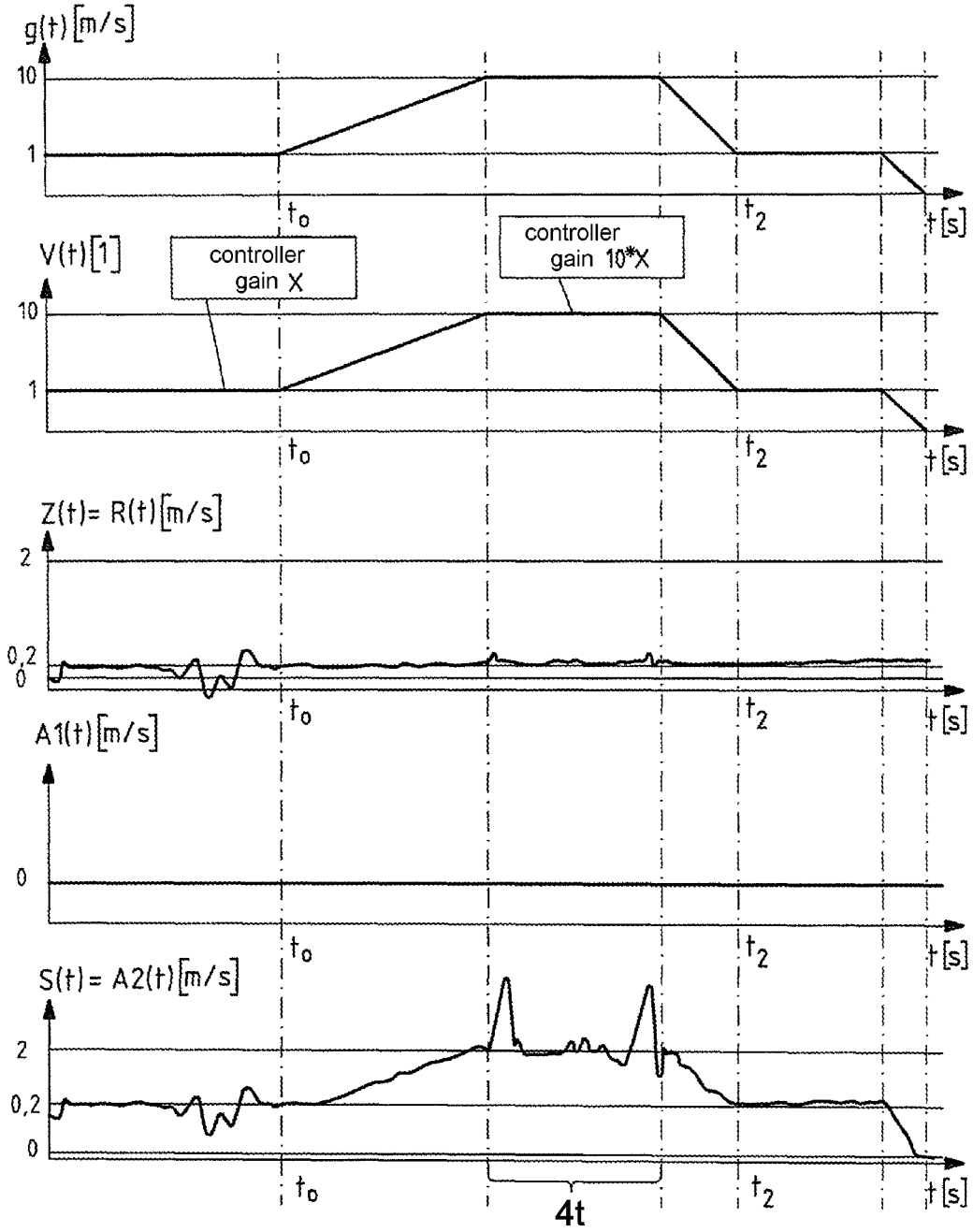
FIG. 4 shows exemplary signal plots for a second variant of the method according to the invention.

One example for such a calculation of the actuating signal S(t) according to the second variant is represented in FIG. 4. Also in FIG. 4 a comparison of the controller output signal R(t) with the actuating signal S(t) shows that the controller output signal is weighted or varied according to the invention in dependence on the gain factor V(t) or in dependence on the variable g(t) representing the speed of the metal band. By contrast with the weighting per the first variant, the weighting in the second variant is implemented much more immediately, this is shown by the actually proportionate gain in the local maxima and minima, especially in the region Δt. In the first variant, this is not amplified, or only in weakened manner, as can be seen from the signal profile S(t) in FIG. 3.

The second variant can be used not only when the tension control is in a steady state, but also even before reaching the steady state, e.g., when a metal band is being threaded into a mill, especially between the two clamping points, or during a tension build-up sequence, etc. Then, for variant 2, the following mathematical relation applies, for example:

$$V(t)=1$$

Hence $$S(t)=R(t)$$

This then corresponds to a direct switch-through/use of the controller output signal R(t) as the actuating signal S(t) for the rotary drive. In that case, the conversion of R(t) into S(t) according to the invention will not occur, or is reduced to a short circuit.

III. Statements Holding for Both the First and the Second Variant

If the tension control is in a steady state, it may be operated according to the invention either by the first or the second variant. In FIGS. 3 and 4 this steady state begins each at time to with the speed g(to). A switching between the first and the second variant can also be done in the steady state.

A switching to the second variant may be done if a more favorable control behavior can be achieved due to a speed change in the mill, since the dynamics of the tension controller is likewise changed by virtue of the speed change. In the second variant, an adapting of the dynamics will occur automatically, at least in part, by the conversion of the variable R(t) into S(t) according to the invention.

The direct amplification of the controller signal R(t) during the conversion into the actuating signal S(t) per the second variant has the advantage that the controller can be set up more quickly, since the dependency of the control dynamics on the speed is at least partly solved by the conversion of R(t) to S(t) according to the invention. The resulting continuous adapting of the dynamics of the controller to the requirements during and after a speed change can also be more precise as compared to the traditional adjustment for different working points.

In certain situations, it may be advantageous not to further increase the gain of the controller output R(t) during the conversion into S(t). If this is the case, a switching from variant two to variant one may be done. This switching from variant two to variant one as well as the switching back from variant one to variant two preferably occurs by an additional logic, which prevents the actuating signal S(t) from changing on account of the switchover. For example, a switching from variant two to variant one will occur when the dynamics of the drive is the limiting variable of the tension controller dynamics.

For both the first and the second variant there again exists the possibility of positively limiting the speed factor $$V(t)=\frac{g(t)}{g(t_0)},$$

for example. One example of the limiting is:

$$V(t)=g_{max}/g(t0) \text{ , if } g(t)\geq g_{max};$$

otherwise:

$$V(t)=\frac{g(t)}{g(t_0)} \tag{1}$$

Thus, V(t) is constant at speeds $\geq g_{max}$. This makes it possible, at high speeds, to hold the correction of the tension controller absolute and the gain of the controller constant.

LIST OF REFERENCE NUMBERS

100 Tension control
110 Desired/actual value comparator
120 Controller
130 Conversion device
140 Actuating element, especially a rotary drive
150 Control system with two clamping points
160 Determination device for the actual tension
200 Band-shaped material, especially metal band
e(t) (Tension) control error
R(t) Controller output signal
S(t) Actuating signal for rotary drive
V(t) Gain factor
a(t) Derivative signal
g(t) Variable representing the speed of the metal band
ti Time

The invention claimed is:

1. A method for tension control in a band-shaped material between two clamping points, wherein the two clamping points are two neighboring rolling stands of a rolling mill, wherein at least one of the rolling stands comprises a rotary drive for driving rotation of one roll of the roll stand or wherein one of the two clamping points is a pair of rolls and the other of the two clamping points is a coiling device downstream in a rolling direction, wherein the pair of rolls comprises the rotary drive for driving the rotation of a least one of the rolls and/or the coiling device comprises the rotary drive for driving rotation of a coil, the method comprising the steps of:

determining actual tension between the two clamping points;

comparing the actual tension and a given desired tension in a comparator to determine a control error e(t) as a difference between the actual tension and a given desired tension;

entering the control error e(t) on a controller to generate a controller output signal R(t);

converting the controller output signal R(t) into an actuating signal S(t) with a conversion device;

varying speed of the rotary drive as an actuating element in accordance with the actuating signal S(t) to regulate the actual tension to the desired tension of the band-shaped material in the rolling mill;

and varying the controller output signal R(t) in connection with the conversion into the actuating signal S(t) by the conversion device at least temporarily in dependence on a variable g(t) representing speed of the band-shaped material, the method including, in a first variant:

forming with the conversion device a gain factor V(t):

$$V(t) = \frac{g(t)}{g(t_0)}, \tag{1}$$

which represents a curve of the variable g(t) representing the speed of the band-shaped material plotted against time, normalized to a given constant $g(t_0)$; and forming the actuating signal S(t) by the following formula:

$$S(t) = R(t) - \sum_{t_i \le t}(A_1(t_i)) + \frac{g(t)}{g(t_0)} * \sum_{t_i \le t}\left(\frac{A_1(t_i)}{V(t_i)}\right) \tag{2}$$

with:

A1(t0) given

Z(t0) given $t_i$: learning times $t_0$: first learning time.

2. The method according to claim 1, wherein times at which the variable g(t) representing the speed of the band-shaped material each reach a given threshold value $g_{LPi}$, or at which the variable g(t) representing the speed of the band-shaped material is no longer constant, but begins to change so that dg(t)/dt≠0 or at which magnitude of Al(t)—during an acceleration phase of the band-shaped material—goes beyond a given threshold value $A_{1max}$, are set respectively as the learning times $t_i$.

3. The method according to claim 1, wherein the actuating signal (S(t)) is computed by formula (2) in the conversion device, when the variable g(t) representing the speed of the band-shaped material falls below a given upper threshold value $g_{max}$ and goes beyond a given lower threshold value $g_{min}$.

4. The method according to claim 1, including operating the tension control in a second variant so that a gain factor V(t) is formed by the conversion device as:

$$V(t) = \frac{g(t)}{g(t_0)}, \tag{1}$$

which represents the curve of the variable g(t) representing the speed of the band-shaped material plotted against time, normalized to a given constant g(t0); and the actuating signal S(t) is formed by the following formula:

$$S(t)=R(t)*V(t), \tag{3}$$

with

R(t): controller output signal.

5. The method according to claim 4, wherein the actuating signal S(t) is computed in the conversion device by formula (3), when the variable g(t) representing the speed of the band-shaped material falls below a given upper threshold value $g_{max2}$ and goes beyond a given lower threshold value $g_{min2}$; or when the gain factor V(t) is supposed to have a greater influence on the dynamics of the tension control than in formula (2); or before the tension control is in a steady state, in which case then: V(t)=1.

6. The method according to claim 4, wherein the tension control is switched from the second variant to the first variant as soon as and for as long as:

$$g(t) > g_{min1} > g_{max2} \tag{4}.$$

7. The method according to claim 4, wherein the gain factor V(t) is confined to a constant value if the variable g(t) representing the speed of the band-shaped material goes beyond a given threshold value $g_{maxi}$.

8. The method according to claim 7, wherein in the case of formula 2: $g_{min1} < g_{maxi} < g_{max1}$; (5) or in the case of formula 3: $g_{min2} < g_{maxi} < g_{max2}$ (6).

9. The method according to claim 4, wherein the actuating signal S(t) is computed as in the second variant if the tension control is in a steady state.

10. The method according to claim 1, wherein the actuating signal S(t) is computed as in the first variant if the tension control is in a steady state.

11. The method according to claim 1, wherein the actuating variable S(t) is limited in the conversion device in dependence on the variable g(t) representing the speed g(t) of the band-shaped material (200), as follows:

$$S_{min}(g(t))<S(t)<S_{max}(g(t)) \quad (7).$$

12. The method according to claim 1, wherein the actuating signal S(t) is computed by factoring in a forward slip of the band-shaped material.

13. The method according to claim 12, wherein the actuating signal S(t) is computed by multiplication with a function f(k), where k is the forward slip.

14. The method according to claim 12, wherein the forward slip k(g(t)) in turn is computed in dependence on the variable g(t) representing the speed g(t) of the band-shaped material.

15. The method according to claim 12, wherein the forward slip is given as a constant.

16. The method according to claim 1, wherein alternatively or additionally to the actuating signal S(t), a derivative signal of form dS(t)/dt, representing a correction of acceleration of the rotary drive, is also provided as an input signal for the rotary drive.

17. The method according to claim 1, wherein the controller output signal R(t) represents a change in the rotary speed for the rotary drive.

18. The method according to claim 1, wherein a thickness control is done at a first of the rolling stands in a rolling direction; and at a following second of the rolling stands in the rolling direction the rotary drive is present and actuated for at least one of the rolls of the second rolling stand, and wherein the tension of the band-shaped material clamped between the first and the second rolling stand is controlled by the rotary drive of the second rolling stand being actuated by the actuating signal S(t).

19. The method according to claim 18, wherein the controller output signal R(t) represents a change in a thickness decrease of the band-shaped material at the first rolling stand as a clamping point and functions as the actuating signal for the thickness decrease at the first rolling stand; and the controller output signal R(t) is converted as recited in the first or second variant into the actuating signal for the rotary drive, wherein the conversion also involves a conversion of the change in the thickness decrease into a change in the rotary speed for the rotary drive.

20. The method according to claim 1, wherein the pair of rolls is a pair of drive rolls or a pair of working rolls in a rolling stand.

21. A method for tension control in a band-shaped material between two clamping points, wherein the two clamping points are two neighboring rolling stands of a rolling mill, wherein at least one of the rolling stands comprises a rotary drive for driving rotation of one roll of the roll stand or wherein one of the two clamping points is a pair of rolls and the other of the two clamping points is a coiling device downstream in a rolling direction, wherein the pair of rolls comprises the rotary drive for driving the rotation of a least one of the rolls and/or the coiling device comprises the rotary drive for driving rotation of a coil, the method comprising the steps of:

determining actual tension between the two clamping points;

comparing the actual tension and a given desired tension in a comparator to determine a control error e(t) as a difference between the actual tension and a given desired tension;

entering the control error e(t) on a controller to generate a controller output signal R(t);

converting the controller output signal R(t) into an actuating signal S(t) with a conversion device;

varying speed of the rotary drive as an actuating element in accordance with the actuating signal S(t) to regulate the actual tension to the desired tension of the band-shaped material in the rolling mill;

and varying the controller output signal R(t) in connection with the conversion into the actuating signal S(t) by the conversion device at least temporarily in dependence on a variable g(t) representing speed of the band-shaped material, the method further including forming with the conversion device a gain factor V(t) as:

$$V(t) = \frac{g(t)}{g(t_0)}, \quad (1)$$

which represents the curve of the variable g(t) representing the speed of the band-shaped material plotted against time, normalized to a given constant g(t0); and forming the actuating signal S(t) the following formula:

$$S(t)=R(t)*V(t), \quad (3)$$

with

R(t): controller output signal.

* * * * *